US009114516B2

(12) United States Patent
Porth

(10) Patent No.: US 9,114,516 B2
(45) Date of Patent: Aug. 25, 2015

(54) PORTABLE COMBUSTION GAS-POWERED TOOLS WITH COMBUSTION CHAMBER LOCKOUT SYSTEM

(75) Inventor: Christopher H. Porth, Gurnee, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 939 days.

(21) Appl. No.: 13/188,061

(22) Filed: Jul. 21, 2011

(65) Prior Publication Data

US 2013/0020371 A1 Jan. 24, 2013

(51) Int. Cl.
*B25C 1/04* (2006.01)
*B25C 1/08* (2006.01)

(52) U.S. Cl.
CPC ..... *B25C 1/08* (2013.01)

(58) Field of Classification Search
CPC ..... B25C 1/008; B25C 1/08; B25C 1/043; B25C 1/188; B25C 1/06; B25C 1/047; B25C 1/041; B25C 1/042; B25C 1/18; B25C 1/105
USPC ..... 227/8, 9, 10, 130, 131, 11; 123/46 SC
See application file for complete search history.

(56) References Cited

U.S. PATENT DOCUMENTS

| | | | | |
|---|---|---|---|---|
| 3,158,949 | A * | 12/1964 | Freed | 42/65 |
| 4,100,383 | A * | 7/1978 | Piber | 307/126 |
| 4,403,722 | A | 9/1983 | Nikolich | |
| 4,483,473 | A | 11/1984 | Wagdy | |
| 4,483,474 | A | 11/1984 | Nikolich | |
| 4,522,162 | A | 6/1985 | Nikolich | |
| RE32,452 | E | 7/1987 | Nikolich | |
| 5,133,329 | A | 7/1992 | Rodseth et al. | |
| 5,197,646 | A * | 3/1993 | Nikolich | 227/8 |
| 5,263,439 | A | 11/1993 | Doherty et al. | |
| 5,558,264 | A | 9/1996 | Weinstein | |
| 5,962,804 | A * | 10/1999 | Lee | 89/1.14 |
| 6,145,724 | A | 11/2000 | Shkolnikov et al. | |
| 6,260,519 | B1 * | 7/2001 | Phillips | 123/46 R |
| 6,715,655 | B1 * | 4/2004 | Taylor et al. | 227/8 |
| 6,783,045 | B2 | 8/2004 | Shima et al. | |
| 7,040,521 | B2 | 5/2006 | Kolodziej et al. | |
| 7,673,779 | B2 | 3/2010 | Moeller et al. | |
| 2007/0034659 | A1 | 2/2007 | Moeller et al. | |
| 2007/0215664 | A1 * | 9/2007 | Moeller et al. | 227/2 |
| 2008/0314953 | A1 | 12/2008 | Moeller et al. | |
| 2009/0206120 | A1 | 8/2009 | Komazaki et al. | |

FOREIGN PATENT DOCUMENTS

| | | |
|---|---|---|
| DE | 20 2009 000 198 | 8/2009 |
| WO | 2007034850 | 3/2007 |

* cited by examiner

*Primary Examiner* — Nathaniel Chukwurah
(74) *Attorney, Agent, or Firm* — Greer, Burns & Crain Ltd.; Maurice E. Finnegan, III

(57) ABSTRACT

A combustion-powered fastener-driving tool includes a combustion-powered power source including a cylinder head and a combustion chamber defined by the cylinder head, a valve sleeve and an upper surface of a reciprocating piston, the valve sleeve reciprocable relative to the cylinder head between a rest position and a pre-firing position. A lockout device is associated with the trigger and has an actuated position configured for preventing the reciprocation of the valve sleeve away from the pre-firing position until the trigger is released.

9 Claims, 7 Drawing Sheets

PORTABLE COMBUSTION GAS-POWERED TOOLS WITH COMBUSTION CHAMBER LOCKOUT SYSTEM

BACKGROUND OF THE INVENTION

The present invention relates generally to fastener-driving tools used to drive fasteners into workpieces, and specifically to combustion-powered fastener-driving tools, also referred to as combustion tools or combustion nailers. The invention is specifically directed towards lockout devices for retaining the combustion chamber of such combustion tools closed to allow return of the piston to a prefiring position.

Combustion-powered tools are known in the art. Representative tools are manufactured by Illinois Tool Works, Inc. of Glenview, Ill. for use in driving fasteners into workpieces, and are described in commonly assigned patents to Nikolich U.S. Pat. Re. No. 32,452, and U.S. Pat. Nos. 4,522,162; 4,483,473; 4,483,474; 4,403,722; 5,133,329; 5,197,646; 5,263,439, 6,145,724 and 7,673,779 all of which are incorporated by reference herein.

Such tools incorporate a tool housing enclosing a small internal combustion engine or power source. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: mixing the fuel and air within the chamber; turbulence to increase the combustion process; scavenging combustion by-products with fresh air; and cooling the engine. The engine includes a reciprocating piston with an elongated, rigid driver blade disposed within a cylinder body.

A valve sleeve is axially reciprocable about the cylinder and, through a connecting member linkage, moves to close the combustion chamber when a workpiece contact element at the end of the linkage is pressed against a work surface. This pressing action also triggers a fuel-metering valve to introduce a specified volume of fuel into the closed combustion chamber.

Upon the pulling or depressing of a trigger switch, which causes the spark to ignite a charge of gas in the combustion chamber of the engine, the combined piston and driver blade is forced downward to impact a positioned fastener and drive it into the workpiece. The piston then returns to its original or pre-firing position, through differential gas pressures within the cylinder. Fasteners are fed magazine-style into the nosepiece, where they are held in a properly positioned orientation for receiving the impact of the driver blade. Upon ignition of the combustible fuel/air mixture, the combustion in the chamber causes the acceleration of the piston/driver blade assembly and the penetration of the fastener into the workpiece if the fastener is present.

Traditionally, combustion-powered tools have been designated as sequentially operated. In other words, the tool must be pressed against the workpiece, collapsing the workpiece contact element (WCE) before the trigger is pulled for the tool to fire or drive a nail. Another aspect of sequential operation of combustion nailers is that only after a valve sleeve position switch, commonly referred to as a "chamber switch" and a trigger switch have been closed in the order mentioned and then opened, will a subsequent engine cycle be permitted. Such an operational control, described in U.S. Pat. No. 5,133,329, incorporated by reference, prevents unwanted ignition or other tool feature operations, such as electronic fuel injection (EFI), in instances when both switches remain closed after an engine cycle is complete.

One distinguishing feature that limits combustion-powered tools to sequential operation is the manner in which the drive piston is returned to the initial position after the tool is fired. Combustion-powered tools utilize self-generative vacuum to perform the piston return function. In order for the self-generative vacuum arrangement to work, the combustion chamber must remain in a closed and sealed condition while the piston is returning to its initial position.

With combustion-powered tools of the type disclosed in the patents incorporated by reference above, by firing rate and control of the valve sleeve the operator controls the time interval provided for the vacuum-type piston return. The formation of the vacuum occurs following the combustion of the mixture and the exhausting of the high-pressure burnt gases. With residual high temperature gases in the tool, the surrounding lower temperature aluminum components cool and collapse the gases, thereby creating a vacuum. In many cases, such as in trim applications, the operator's cycle rate is slow enough that vacuum return works consistently and reliably.

Recently portable fastener driving tools that drive collated fasteners disposed in a coil magazine have been developed for newer and harder construction material applications requiring a tool power that falls in between tools previously available for framing applications and trim applications, resulting in a new size of linear combustion motor. These new size linear engines deliver more power for specific applications. With the ability to drive a fastener into harder materials, these tools have a tendency to prematurely lift off of the work surface, thereby creating a leak in the sealing of the combustion chamber, hence losing pressure which affects the tool's proper nail driving ability. This may also cause the vacuum to be lost and piston return travel to stop before reaching the top of the cylinder. In such a situation, the driver blade would remain in the guide channel of the nosepiece, thereby preventing the nail strip from advancing. The net result is no nail in the firing channel and no nail fired in the next cycle.

To assure adequate closed combustion chamber dwell time in the combustion tools identified above, a chamber lockout device is linked to the trigger. This mechanism holds the combustion chamber closed until the operator releases the trigger. This extends the dwell time (during which the combustion chamber is closed) by taking into account the operator's relatively slow musculature response time. In other words, the physical release of the trigger consumes enough time of the firing cycle to assure piston return. The mechanism also maintains a closed chamber in the event of a large recoil event created, for example, by firing into a hard material or on top of another nail.

Commonly-assigned U.S. Pat. No. 6,145,724 describes a cam mechanism that is operated by the driver blade to prevent premature opening of the combustion chamber prior to return of the piston/driver blade to the pre-firing position (also referred to as pre-firing). The main deficiency of this approach is that the piston requires the use of a manual reset rod to return the piston to pre-firing if the piston does not fully return due to a nail jam or perhaps a dirty/gummy cylinder wall. A piston that does not return will cause the chamber to remain closed; therefore the tool cannot be fired again.

Another type of lockout device for combustion-powered tools is disclosed in U.S. Pat. No. 6,783,045, in which a reciprocating solenoid locking device is used to restrain the valve sleeve in the sealed position to hold the combustion chamber sealed for a predetermined amount of time during which the piston should return. It has been found that the preferred embodiment of the '045 patent requires precise spatial component relationships and corresponding timing of operations to be satisfied for reliable operation between the retractable solenoid and the mating shoulders or apertures on the valve sleeve. Such precision is difficult to maintain when mass producing the tools. Furthermore, the stressful operational environment of such tools enhances the potential for combustion-induced shock forces to damage the solenoid lockout mechanism.

In U.S. Pat. No. 7,673,779 a lockout mechanism is provided in the manner of an electric solenoid having a plunger that interacts with the valve sleeve to hold the valve sleeve in an elevated, sealed position until the solenoid is deenergized.

Thus, there is a need for an improved combustion-powered fastener-driving tool which is capable of maintaining the combustion chamber in a closed and sealed condition while the trigger remains depressed, even if the tool is lifted off of the work surface. There is also a need for an improved combustion-powered fastener-driving tool which can address the special needs of delaying the opening of the combustion chamber to achieve complete piston return. There is also a need for a lockout device which provides automatic return of the lockout mechanism upon release of the trigger in a reliable mechanical manner.

SUMMARY OF THE INVENTION

The above-listed needs are met or exceeded by the present combustion-powered fastener-driving tool which overcomes the limitations of the current technology. Among other things, the present tool incorporates a protrudable element movable by means of depression of the trigger and an interfering portion arranged on a member connecting the work contact element to the valve sleeve. The interfering portion is engageable by the protudable element when the trigger is depressed and the work contacting element is pressed against the work surface, to prevent movement of the combustion chamber support bracket so long as the trigger remains depressed.

In an embodiment, the protrudable element comprises a pin engageable with the trigger and arranged to slide upon depression of the trigger.

In an embodiment, the pin includes a spherical tip at an end facing towards the combustion chamber support bracket.

In an embodiment, the connecting member is an element separate from, but rigidly connected to the valve sleeve.

In an embodiment, the interfering portion is a recess formed in the connecting member.

In an embodiment, the recess arranged on the combustion chamber support bracket comprises an opening extending through the combustion chamber support bracket.

In an embodiment, the trigger carries a cam with a cam slot therein and the protrudable element includes a portion engageable in the cam slot, whereby depression of the trigger will result in reciprocal movement of the protrudable element.

In an embodiment, the reciprocal movement of the pin is perpendicular to the reciprocal movement of the valve sleeve.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DETAILED DESCRIPTION OF THE PREFERRED EMBODIMENTS

Figure 1:
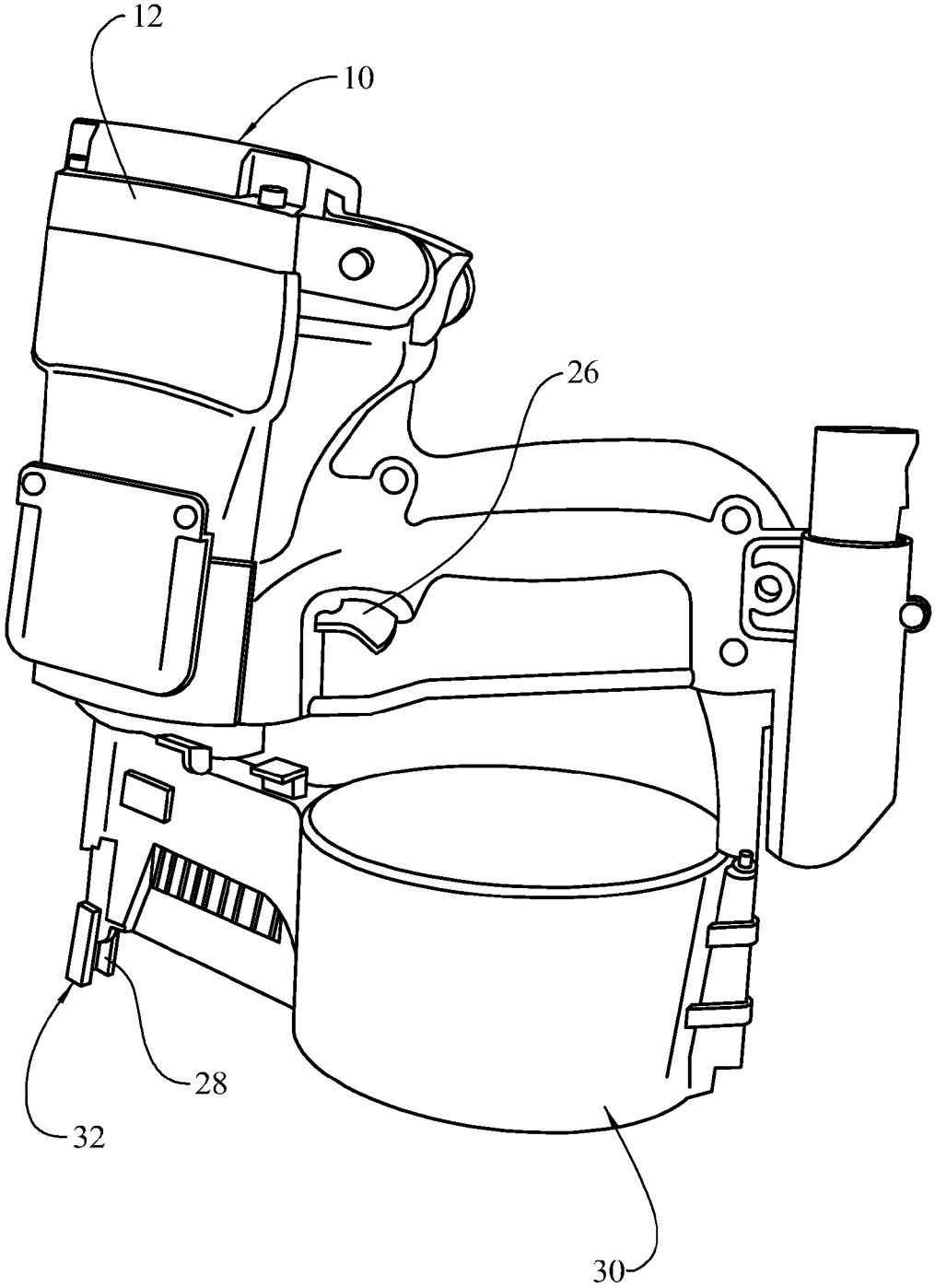
FIG. 1 is a left elevational view of a fastener-driving tool incorporating the present lockout system.
Figure 2:
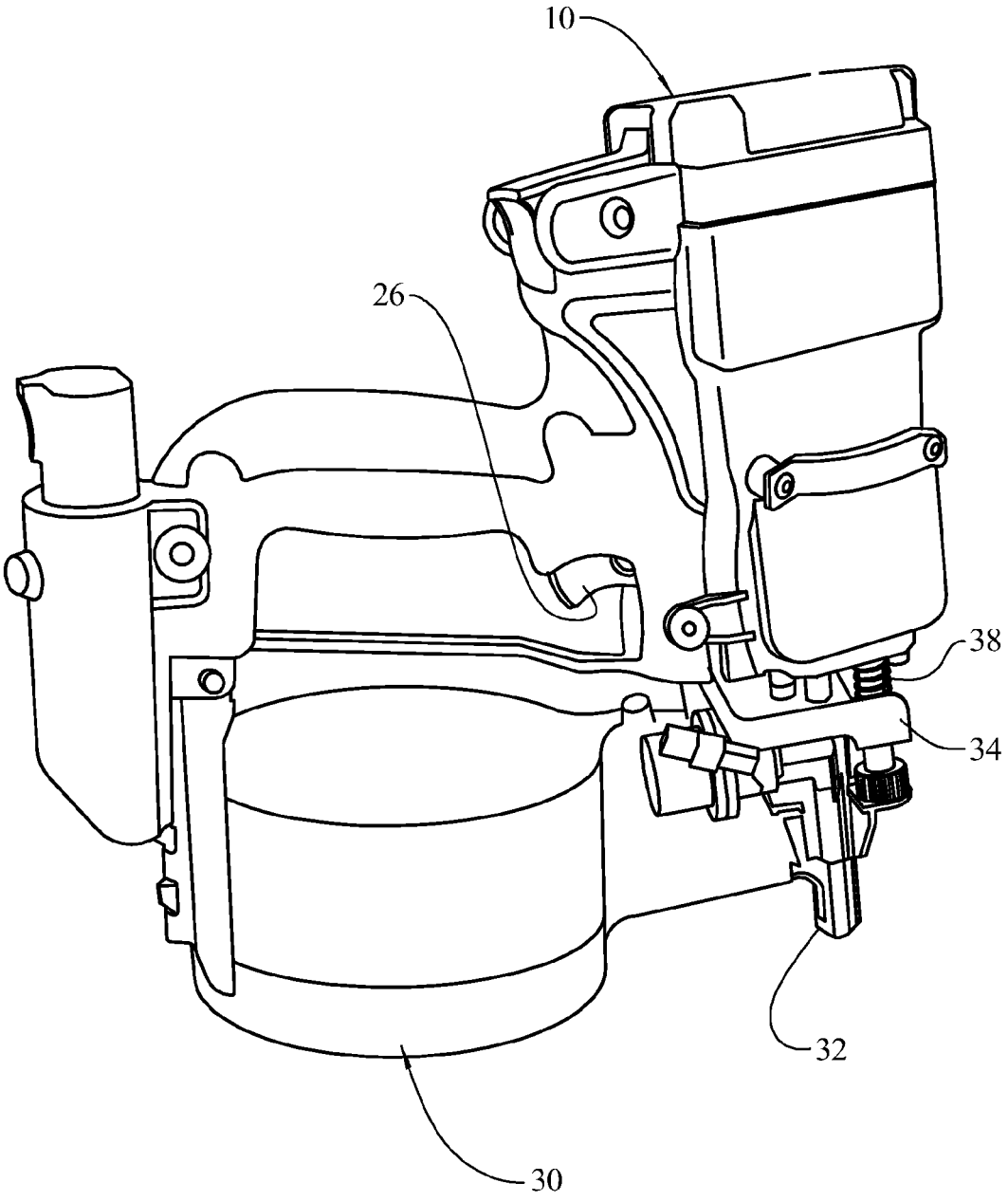
FIG. 2 is a right elevational view of the fastener-driving tool of FIG. 1.
Figure 5:
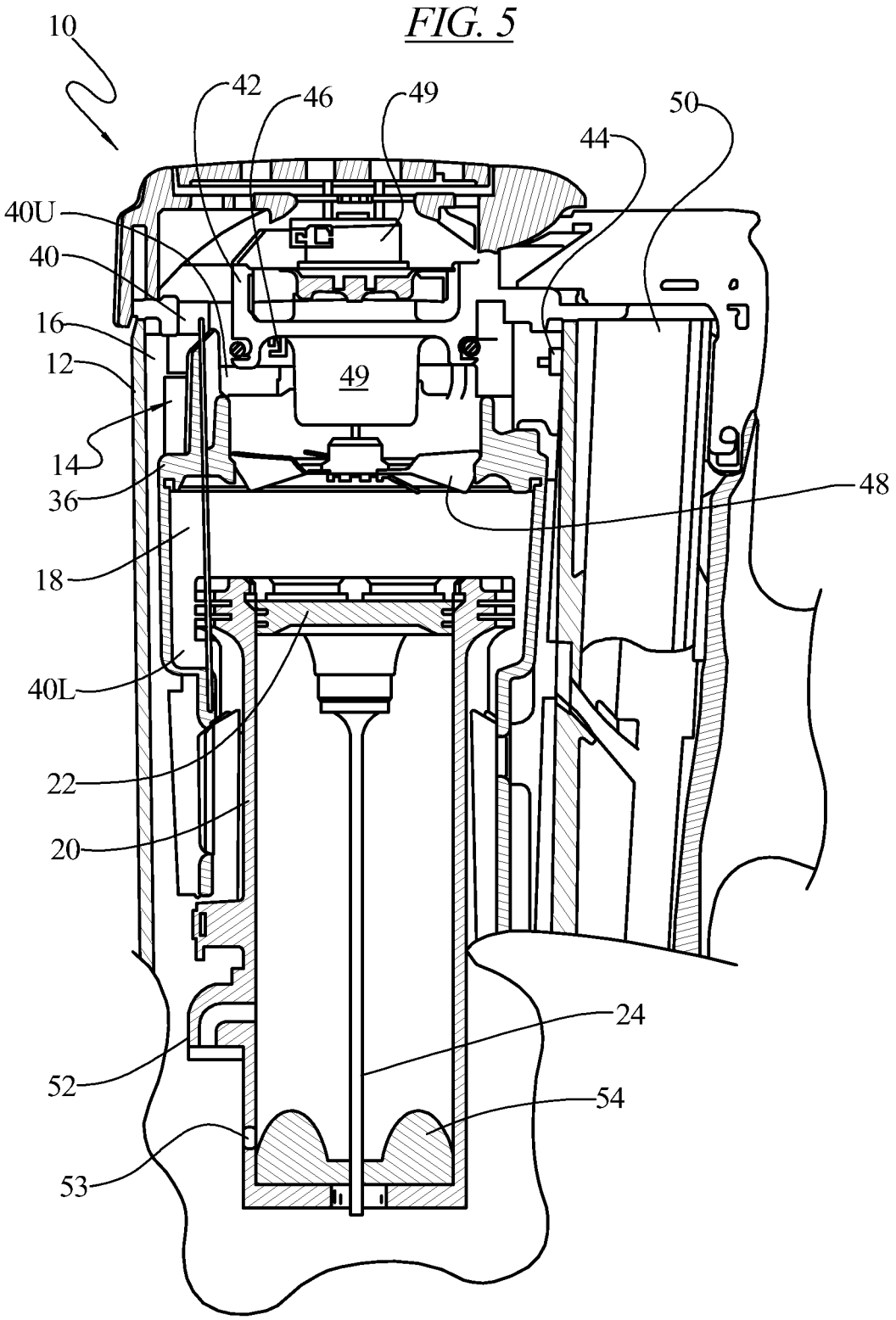
FIG. 5 is a fragmentary vertical cross-section of the tool of FIGS. 1 and 2 shown in the rest position.

Referring now to FIGS. 1 and 2, a combustion-powered fastener-driving tool incorporating the present invention is generally designated 10 and preferably is of the general type described in detail in the patents listed above and incorporated by reference in the present application. A housing 12 of the tool 10 encloses a self-contained internal power source 14 (FIG. 5) within a housing main chamber 16. As in conventional combustion tools, the power source 14 is powered by internal combustion and includes a combustion chamber 18 that communicates with a cylinder 20. A piston 22 reciprocally disposed within the cylinder 20 is connected to the upper end of a driver blade 24. As shown in FIG. 5, an upper limit of the reciprocal travel of the piston 22 is referred to as a piston pre-firing position, which occurs just prior to firing, or the ignition of the combustion gases which initiates the downward driving of the driver blade 24 to impact a fastener (not shown) to drive it into a workpiece.

Through pulling or depression of a trigger 26 (FIG. 1) and actuation of an associated trigger switch (not shown, the terms trigger and trigger switch are used interchangeably), a user induces combustion within the combustion chamber 18, causing the driver blade 24 to be forcefully driven downward through a nosepiece 28 (FIG. 1). The nosepiece 28 guides the driver blade 24 to strike a fastener that had been delivered into the nosepiece via a fastener magazine 30.

Figure 3:
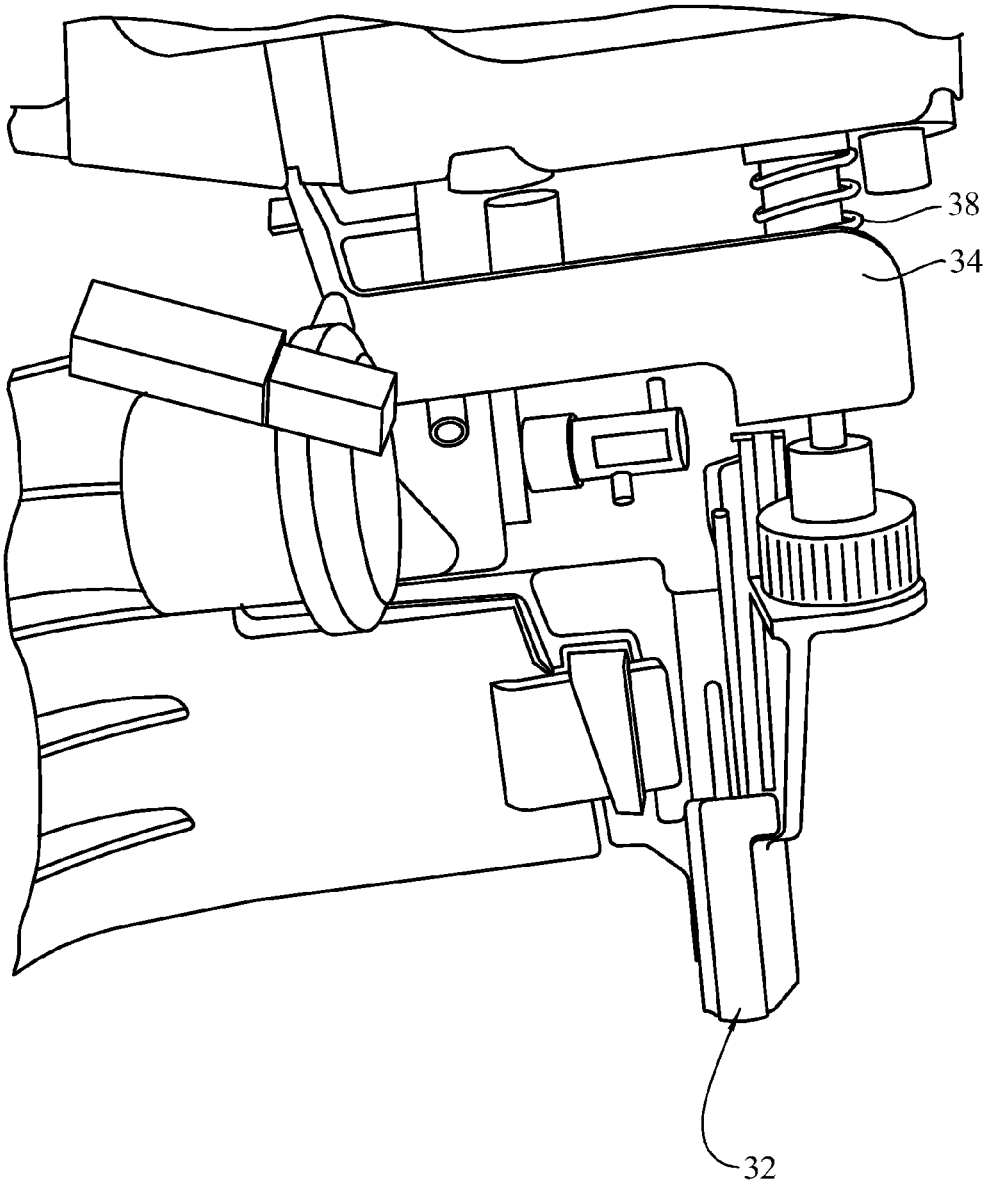
FIG. 3 is an enlarged partial view of the fastener-driving tool of FIG. 2.

Included in the nosepiece 28 is a reciprocal workpiece contact element 32, which is connected, through a linkage or upper probe 34 and a connecting member 35, which may be in the form of a combustion chamber support bracket (FIG. 4) to a reciprocating valve sleeve 36, which partially defines the combustion chamber 18 (FIG. 5). Depression of the tool housing 12 against a work surface (not shown) in a downward direction as seen in FIG. 1 (other operational orientations are contemplated as are known in the art), causes the workpiece contact element 32 to move relative to the tool housing 12 toward the cylinder head 42 from a rest position to a pre-firing position. This movement overcomes the normally downward biased orientation of the workpiece contact element 32 caused by a spring 38 (FIGS. 2 and 3). It is contemplated that the location of the spring 38 may vary to suit the application, and locations displaced farther from the nosepiece 28 are envisioned.

Through the linkage 34 and the connecting member or combustion support bracket 35, the workpiece contact element 32 is connected to, or in contact with, and reciprocally moves with, the valve sleeve 36. In the rest position (FIG. 5), the combustion chamber 18 is not sealed, since there is an annular gap 40 including an upper gap 40U separating the valve sleeve 36 and a cylinder head 42, which accommodates a spark plug 46, and a lower gap 40L separating the valve sleeve and the cylinder 20. A chamber switch 44 (sometimes referred to as a head switch) is located in proximity to the valve sleeve 36 to monitor its positioning. In the present tool 10, the cylinder head 42 also is the mounting point for a cooling fan 48 and a fan motor 49 powering the cooling fan. In the rest position depicted in FIG. 5, the tool 10 is disabled from firing because the combustion chamber 18 is not sealed at the top with the cylinder head 42, and the chamber switch 44 is open.

Firing is enabled when a user presses the workpiece contact element 32 against a work surface. This action overcomes the biasing force of the spring 38, causes the valve sleeve 36 to move upward relative to the housing 12, closing the gaps 40U and 40L and sealing the combustion chamber 18 until the chamber switch 44 is activated. An upper end 45 and a lower end 47 of the valve sleeve 36 form two circular seats which engage combustion seals, preferably an O-ring but other types of sliding seals are contemplated. This operation also induces a measured amount of fuel to be released into the combustion chamber 18 from a fuel canister 50 (shown in fragment).

Figure 6:
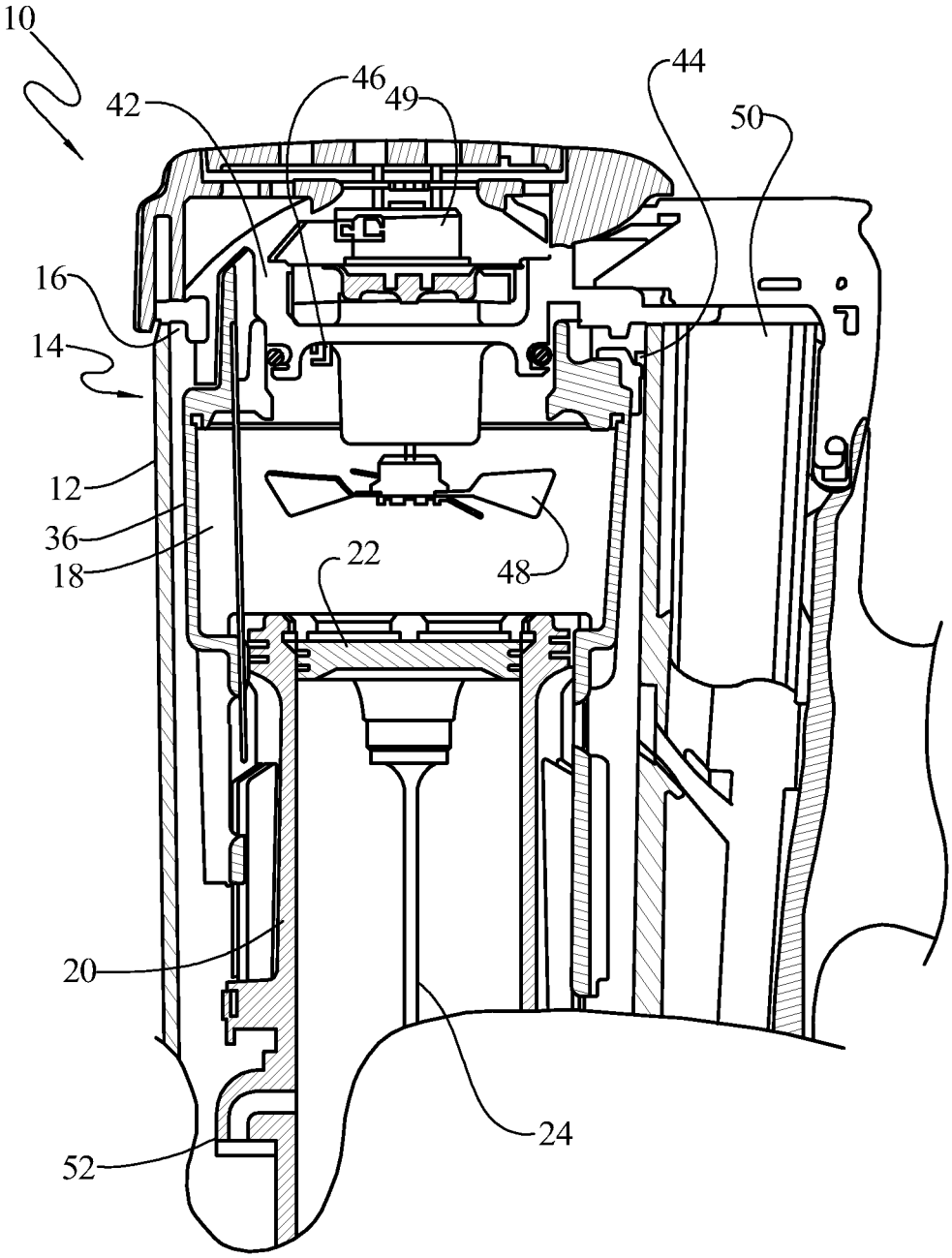
FIG. 6 is a fragmentary vertical cross-section of the tool of FIGS. 1 and 2 shown in the pre-firing position.

As the valve sleeve 36 progresses towards the cylinder head 42, the upper end 45 moves past a first seal position at which point the combustion seals are engaged by the upper end and the lower end of the valve sleeve 36, and the combustion chamber 18 is sealed, further progression actuates the chamber switch 44, and ultimately the valve sleeve reaches an upper limit of its travel, referred to as a pre-firing position (FIG. 6). In other words, the valve sleeve 36 may be designed to have a certain specified amount of overtravel after the combustion chamber 18 is sealed. Among other things, this overtravel allows for a wide operational range of the valve sleeve 36, a lockout device and the chamber switch 44, and positive combustion chamber sealing during tool recoil.

Upon pulling the trigger 26, the spark plug 46 is energized, igniting the fuel and air mixture in the combustion chamber 18 and sending the piston 22 and the driver blade 24 downward toward the waiting fastener for entry into the workpiece. As the piston 22 travels down the cylinder, it pushes a rush of air which is exhausted through at least one petal or check valve 52 and at least one vent hole 53 located beyond piston displacement (FIG. 5). At the bottom of the piston stroke or the maximum piston travel distance, the piston 22 impacts a resilient bumper 54 as is known in the art. With the piston 22 beyond the exhaust check valve 52, high pressure gasses vent from the cylinder 20 until near atmospheric pressure conditions are obtained and the check valve 52 closes. Due to internal pressure differentials in the cylinder 20, the piston 22 is returned to the pre-firing or rest position shown in FIG. 5.

As described above, one of the issues confronting designers of combustion-powered tools of this type is the need for a rapid and complete return of the piston 22 to the piston pre-firing position and improved control of the chamber 18 prior to the next cycle.

Figure 4:
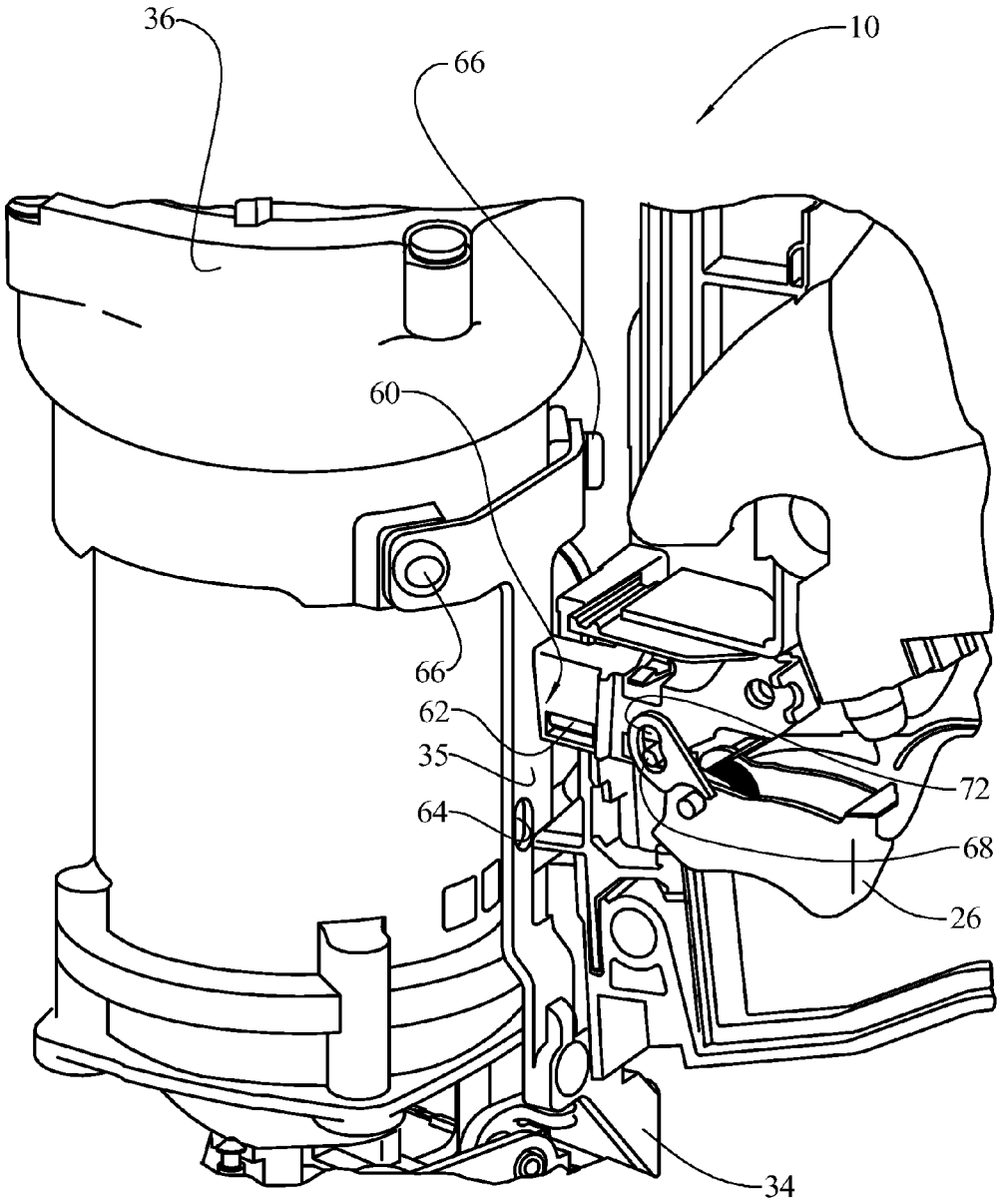
FIG. 4 is an elevational partial view of interior portions of the fastener-driving tool of FIGS. 1 and 2, with several exterior parts removed.
Figure 7:
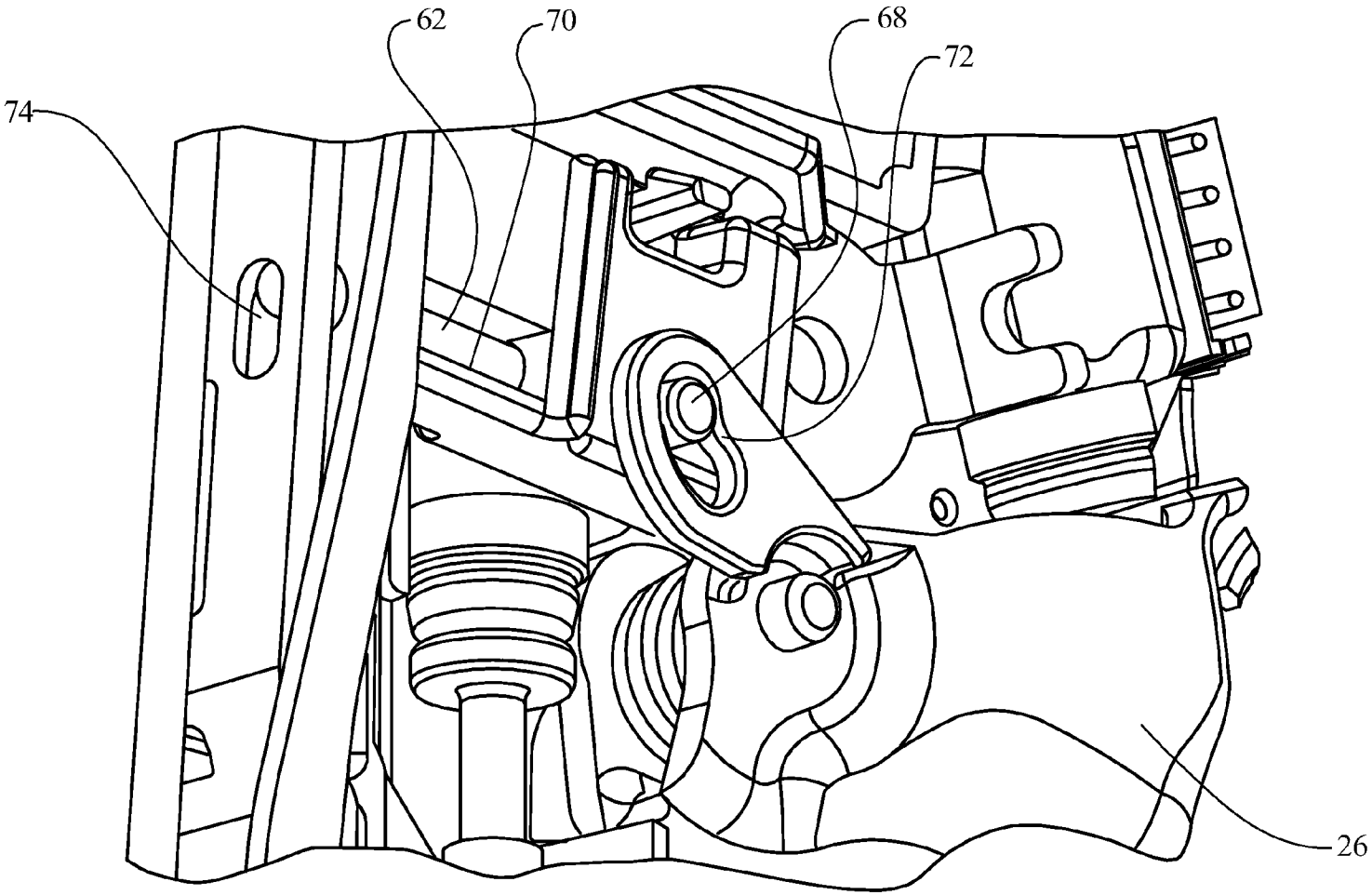
FIG. 7 is an enlarged elevational partial view of the lockout mechanism portion of the fastener-driving tool of FIGS. 1 and 2.

Referring now to FIGS. 4 and 7, to accommodate these design concerns, the present tool 10 preferably incorporates a chamber lockout device, generally designated 60 and configured for preventing the reciprocation of the valve sleeve 36 from the closed or pre-firing position until the trigger 26 is released. This holding, delaying or locking function of the lockout device 60 is operational while the trigger 26 is pulled or depressed to allow a period of time required for the piston 22 to return to the piston pre-firing position. Thus, the user using the tool 10 can lift the tool from the workpiece where a fastener was just driven, or the tool may recoil away from the work surface, all while the combustion chamber 18 temporarily remains sealed.

The lockout device 60 includes a protrudable element 62, which may be in the form of a pin that can slide in response to depression or pulling of the trigger 26. The lockout device 60 also includes an interfering portion 64 arranged on the connecting member 35 which is engageable by the protrudable element when the trigger 26 is depressed and the workpiece contact element 32 is pressed against the work surface (FIG. 7). This engagement between the protrudable element 62 and the interfering portion 64 on the connecting member 35 prevents movement of the connecting member so long as the trigger 26 remains depressed.

The connecting member 35 may be an element separate from, but rigidly connected to the valve sleeve 36. For example, the connecting member 35 may be a combustion chamber support bracket that is rigidly attached to the valve sleeve 36 with bolts 66. The interfering portion 64 may be a recess formed in the connecting member 35 arranged to receive the protrudable element 62 when the connecting member is moved to a receiving position by depressing the workpiece contact element 32 against the work surface.

In the embodiment illustrated, the protrudable element 62 comprises a pin with a leg portion 68 (FIG. 7) engagable with the trigger 26 to reciprocally slide in a slide track 70 when the trigger is depressed. The leg portion 68 of the pin 62 engages with a cam slot 72 provided on the trigger 26. The cam slot 72 moves when the trigger 26 is depressed to reciprocally slide the pin 62 forward or backward in the slide track 70. When the combustion chamber support bracket 35 is moved to the elevated position, the recess 64 in the combustion chamber support bracket aligns with the slide track 70, allowing the pin 62 to be inserted into the recess upon depression of the trigger 26. In an embodiment, the recess 64 may be an opening that extends through the combustion chamber support bracket 35. So long as the trigger 26 remains depressed, the pin 62 will remain engaged in the recess 64, preventing the combustion chamber support bracket 35 from moving downwardly, even though the workpiece contact element 32 may have moved away from the work surface. In this manner, the valve sleeve 36 will remain elevated, and the combustion chamber 18 will remain sealed, so long as the trigger 26 remains depressed.

When the trigger 26 is released, the pivoting of the trigger will cause a movement of the cam slot 72, pulling the pin 62 out of engagement with the combustion chamber support bracket recess 64, allowing the combustion chamber support bracket 35, and the valve sleeve 36, to move downwardly, if the workpiece contact element 32 has moved away from the work surface.

To assist the pin 62 in properly engaging in the recess 64, the pin may have an end 74 facing the combustion chamber support bracket 35 that is shaped to guide the pin into the recess, such as a spherical tip (FIG. 7). As shown in the embodiment illustrated in FIGS. 4 and 7, the reciprocal movement of the pin 62 is perpendicular to the reciprocal movement of the valve sleeve 36.

It has been found that beneficial lockout device function is obtained when the valve sleeve 36 is permitted an amount of overtravel from the first sealed position to the pre-firing position and the lockout device 60 can prevent the valve sleeve from opening the combustion chamber 18 in that range. This arrangement is discussed in detail in U.S. Pat. No. 7,673,779 and incorporated here by reference.

If the valve sleeve 36 of the tool 10 is arranged to have an over-travel while still maintaining the combustion chamber 18 in a closed, sealed condition, the recess 64 or opening in the combustion chamber support bracket 35 may be in the form of a slot as shown in the embodiment illustrated in FIGS. 4 and 7 which will allow some vertical movement of the combustion chamber support bracket and the valve sleeve, yet will maintain the combustion chamber in a closed, sealed condition.

While a particular embodiment of the present combustion chamber control for a combustion-powered fastener-driving tool has been described herein, it will be appreciated by those skilled in the art that changes and modifications may be made thereto without departing from the invention in its broader aspects and as set forth in the following claims.

The invention claimed is:

1. A combustion-powered fastener-driving tool, comprising:

a combustion-powered power source including a combustion chamber defined by a cylinder head, a valve sleeve, a cylinder and an upper surface of a reciprocating piston;

said valve sleeve reciprocable relative to said cylinder head between a rest position where said combustion chamber is unsealed and a pre-firing position where said combustion chamber is sealed;

a reciprocal work contacting element connected to said valve sleeve by a combustion chamber support bracket, said reciprocal work contacting element being movable toward said cylinder head to an elevated position when pressed against a workpiece thereby moving said valve sleeve and said combustion chamber support bracket toward said cylinder head to said pre-firing position;

a trigger arranged on a handle for operating an electrical switch when depressed to generate a spark in said combustion chamber;

a lockout device mounted to the tool and having an actuated position configured for preventing movement of said valve sleeve away from said cylinder head while said trigger is depressed; and said lockout device including a protrudable element movable by means of depression of said trigger and a recess in the form of an opening extending through said combustion chamber support bracket engageable by said protudable element when said trigger is depressed and said work contacting element is pressed against said workpiece, to prevent movement of said combustion chamber support bracket so long as said trigger remains depressed, said protrudable element comprising a pin having a first cylindrical portion with a cylindrical first free end facing towards the valve sleeve and carried in a slide track to reciprocate towards and away from said combustion chamber support bracket and a second portion extending perpendicular from the first portion and being captured in a cam slot on the trigger such that movement of the trigger causes the second portion to move from one portion of the cam slot to a different portion of the cam slot which reciprocally slides the first cylindrical portion of the pin in the slide track, the cylindrical free end of the pin, upon movement of the trigger, when the combustion chamber support bracket is moved to the elevated position, being moved into insertion in the opening through the combustion chamber support bracket, the free end of the pin remaining engaged with the opening through the combustion chamber support bracket so long as the trigger remains depressed.

2. The combustion-powered fastener-driving tool according to claim 1, wherein said pin includes a spherical tip at the free end facing towards said combustion chamber support bracket.

3. The combustion-powered fastener-driving tool according to claim 1, wherein said reciprocal movement of said pin is perpendicular to said reciprocal movement of said valve sleeve.

4. The combustion-powered fastener-driving tool according to claim 1, wherein said opening comprises a slot.

5. A combustion-powered fastener-driving tool, comprising:

a combustion-powered power source including a combustion chamber defined by a cylinder head, a valve sleeve, a cylinder and an upper surface of a reciprocating piston;

said valve sleeve reciprocable relative to said cylinder head between a rest position where said combustion chamber is unsealed and a pre-firing position where said combustion chamber is sealed;

a reciprocal work contacting element connected to said valve sleeve by a connecting member, said reciprocal work contacting element being movable toward said cylinder head to an elevated position when pressed against a workpiece thereby moving said valve sleeve and said connecting member toward said cylinder head to said pre-firing position;

a trigger arranged on a handle for operating an electrical switch when depressed to generate a spark in said combustion chamber;

a lockout device mounted to the tool and having an actuated position configured for preventing movement of said valve sleeve away from said cylinder head while said trigger is depressed; and said lockout device including a protrudable element movable by means of depression of said trigger and a recess in the form of an opening extending through said connecting member engageable by said protudable element when said trigger is depressed and said work contacting element is pressed against said workpiece, to prevent movement of said connecting member so long as said trigger remains depressed, said protrudable element comprising a pin having a first cylindrical portion with a first cylindrical free end facing towards the valve sleeve and carried in a slide track to reciprocate towards and away from said connecting member and a second portion extending perpendicularly from the first portion and being captured in a cam slot on the trigger such that movement of the trigger causes the second portion to move from one portion of the cam slot to a different portion of the cam slot which reciprocally slides the first cylindrical portion of the pin in the slide track, the free cylindrical end of the pin, upon movement of the trigger, when said connecting member is moved to the elevated position, being moved into insertion in the opening through said connecting member, the free cylindrical end of the pin remaining engaged with the opening through said connecting member so long as the trigger remains depressed.

6. The combustion-powered fastener-driving tool according to claim 5, wherein said connecting member is an element separate from, but rigidly connected to said valve sleeve.

7. The combustion-powered fastener-driving tool according to claim 5, wherein said pin includes a spherical tip at said free end facing towards said connecting member.

8. The combustion-powered fastener-driving tool according to claim 5, wherein said reciprocal movement of said pin is perpendicular to said reciprocal movement of said valve sleeve.

9. The combustion-powered fastener-driving tool according to claim 5, wherein said opening comprises a slot.

* * * * *